US005396915A

United States Patent [19]

Bomar

[11] Patent Number: 5,396,915

[45] Date of Patent: Mar. 14, 1995

[54] SHADING APPARATUS

[76] Inventor: John P. Bomar, Rte. 1, Box 29, Troup, Tex. 75789

[21] Appl. No.: 161,195

[22] Filed: Dec. 2, 1993

Related U.S. Application Data

[63] Continuation of Ser. No. 805,013, Dec. 11, 1991, abandoned.

[51] Int. Cl.[6] ..... A45B 3/00

[52] U.S. Cl. ..... 135/16; 135/19; 403/97; 403/391; 403/397; 248/514; 248/534

[58] Field of Search ..... 135/16, 19, 21; 403/96, 403/97, 391, 397; 248/900, 514, 534, 289.1

[56] References Cited

U.S. PATENT DOCUMENTS

| | | | |
|---|---|---|---|
| 504,900 | 9/1893 | Barnes | 135/21 |
| 508,418 | 11/1893 | Hearney | 135/21 X |
| 2,529,755 | 11/1950 | Alter | 403/97 X |
| 2,984,249 | 5/1961 | Sears, Jr. et al. | 135/21 |
| 3,304,035 | 2/1967 | Davis | 248/514 X |
| 3,602,466 | 8/1971 | Drowns | 248/514 |
| 3,765,434 | 10/1973 | Riggs | 135/16 X |
| 3,889,908 | 6/1975 | Larson | 403/97 X |
| 4,244,550 | 1/1981 | Yamada | 135/16 X |
| 4,871,141 | 10/1989 | Chen | 248/534 |
| 4,917,343 | 4/1990 | Wainscott | 403/97 X |

OTHER PUBLICATIONS

Alsto Handy Helper's Catalog, Item No. 4303400 entitled "Tractor Umbrella", 1991.

*Primary Examiner*—Lanna Mai
*Attorney, Agent, or Firm*—David W. Carstens

[57] ABSTRACT

A shading apparatus (10) for use with a riding lawnmower mounts to the seat or other suitably stable part. A shader (12) is of sufficient diameter to shade the rider of a riding lawnmower under most conditions. The shader (12), typically an umbrella is supported by a single shaft (14). Shaft (14) is next inserted into umbrella support bracket (36), a cylindrical receptacle dimensioned to provide a snug fit. The umbrella support bracket (36) can be pivotally connected to a support flange (34) by connection means. The connection means can be a wing nut (26) penetrating both the bracket (36) and the flange (42). Support flange (34), in turn is connected to the riding lawnmower by a plurality of screws (32). Radial ridges on complementary surfaces (40*a*, 42) hold the umbrella (12) in position under normal conditions. However, should the umbrella strike a limb, the force imparted to the shaft (14) overcomes the friction forces between surfaces (40*a*, 42*a*) allowing the umbrella to fall away from the source of the impact.

5 Claims, 3 Drawing Sheets

SHADING APPARATUS

This application is a continuation of application Ser. No. 07/805,013, filed Dec. 11, 1991, now abandoned.

TECHNICAL FIELD OF THE INVENTION

The present invention relates to a shading apparatus and more particularly to a collapsible umbrella device for use with a riding lawnmower or other small, open vehicle.

BACKGROUND OF THE INVENTION

The riding mower is a useful device for mowing large areas of grass and weeds during the spring, summer, and fall. Most riding mowers have an open cab. In other words, the rider is exposed to the elements while mowing. Thus, the rider is exposed to the sometimes intense heat of mid-summer as well as the damaging ultraviolet light associated therewith. In fact, increased awareness of the problems associated with ultraviolet light have led people increasingly to protect their skin. A useful solution to the problems of both intense heat and damaging UV light is to mount an umbrella to the riding mower and above the rider.

A mounted umbrella or shader however presents a significant problem for the rider. It limits his ability to drive the mower under lower branches and the like. If the umbrella or its shaft strikes the branch or limb, either the umbrella or the limb is damaged. Neither result is desirable.

A need exists for an effective shader for the rider of a riding lawnmower or similar open cab vehicle. Such a shader must be large enough to adequately protect the rider from the sun's heat and damaging UV rays. Such a shading apparatus must be easily attachable to a standard riding mower. Moreover, such a shading apparatus must be able to fall away from the rider should it strike a lower limb, branch or other obstacle. In falling away from the rider, the unit must not be damaged and must be easily repositionable above the rider.

SUMMARY OF THE INVENTION

The present invention relates to a shading apparatus for use primarily with a riding lawnmower. The shading apparatus typically takes the form of a collapsible umbrella positioned to protect the rider from the direct heat of the summer sun. Yet, it does not prevent the rider from mowing under low tree limbs because of its ability to collapse away from the rider. If the umbrella is forced to fall backwards, it is easily repositioned above the rider.

The present shading apparatus includes an umbrella supported by a shaft. The shaft is connected to the mower by a pivotal attachment means. The pivotal attachment means can comprise an umbrella support bracket pivotally connected to a support flange. The flange comprises a base with a plurality of screw holes therethrough. Screws are used to secure the base to the riding mower. A flange portion extends perpendicularly from the base. A first hole is centrally located in this flange portion. A first ridged surface is located on the flange portion. The first ridged surface is comprised of a plurality of radially disposed ridges. The bracket comprises a bracket body and a bracket head. The bracket body surrounds and defines a cavity. The umbrella shaft is removably insertable into said cavity. The bracket body is generally cylindrical while the bracket head is generally circular with a centrally located second hole which corresponds to the first hole in the support flange. A second surface is located on the bracket head. This second surface is also comprised of a plurality of ridges similar in size, number and orientation to those on the first ridged surface of the flange portion. However, the radial ridges on second surface are offset from those on the first surface allowing them to intermesh when the bracket is perpendicular to the flange.

Thus, when the bracket and flange are placed adjacent to and perpendicular to each other, the first and second holes line up. Connection means are placed through these holes to pivotally attach these elements. The connection means can include a threaded wing nut and bolt. Washers may also be used as spacers. However, should a force be applied to the umbrella or its shaft, this force will overcome that between the first and second ridged surfaces, allowing the umbrella to fall away from the source of the force. To reposition the umbrella, the rider need only loosen the wing nut and rotate the umbrella into its original position and then retighten the wing nut.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION OF THE INVENTION

Figure 1:
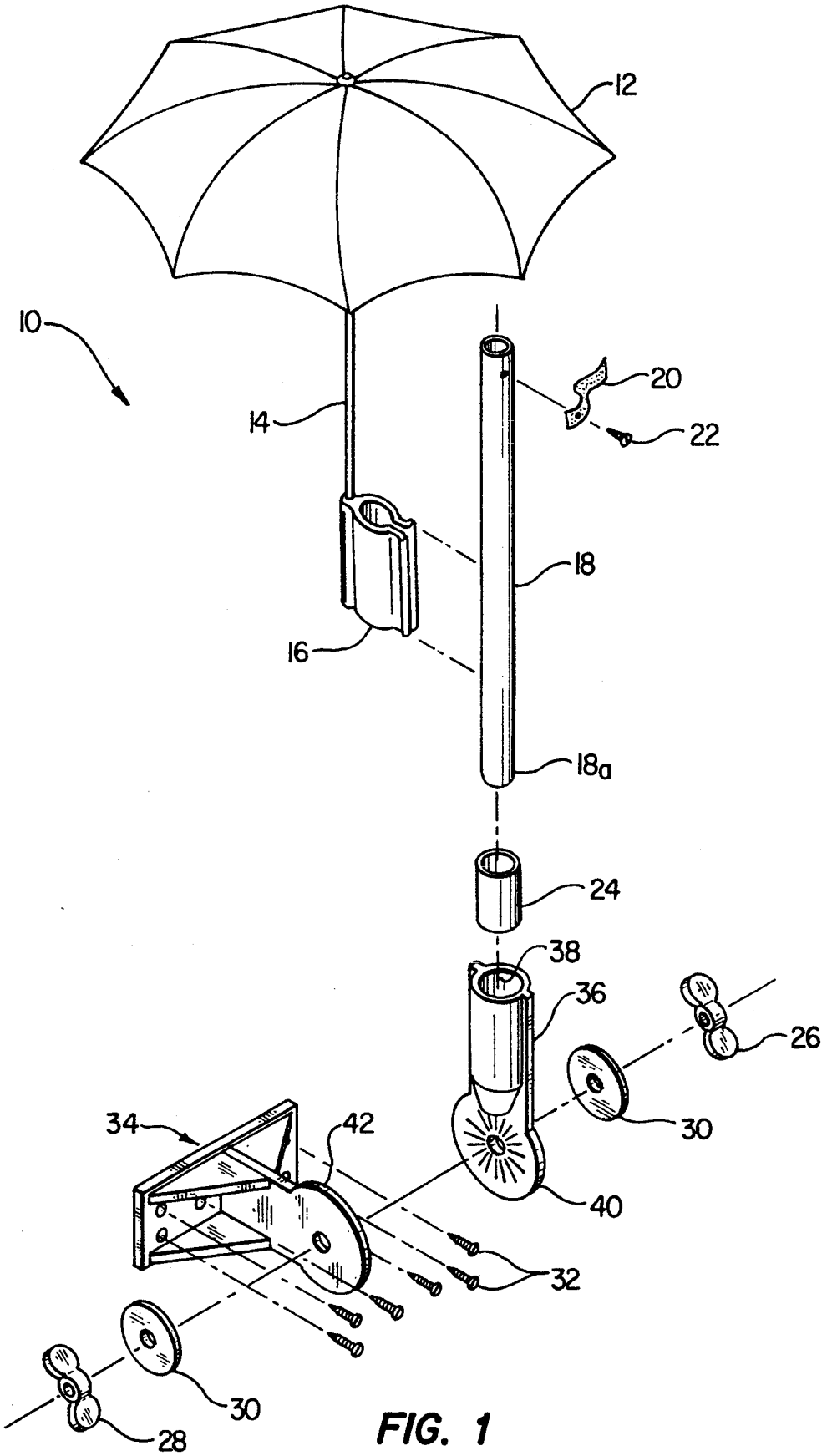
FIG. 1 is an exploded view of an alternate embodiment of the shading apparatus.
Figure 2A:
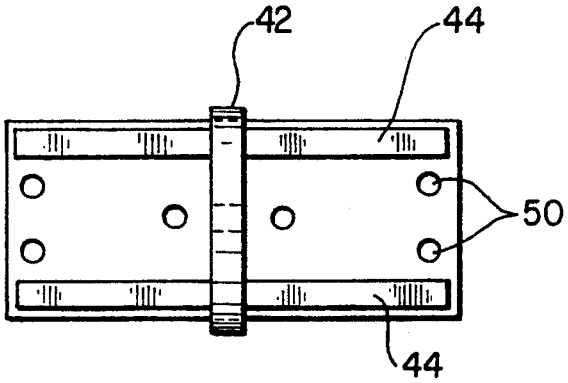
FIG. 2*a* is a front view of the umbrella support flange.
Figure 2B:
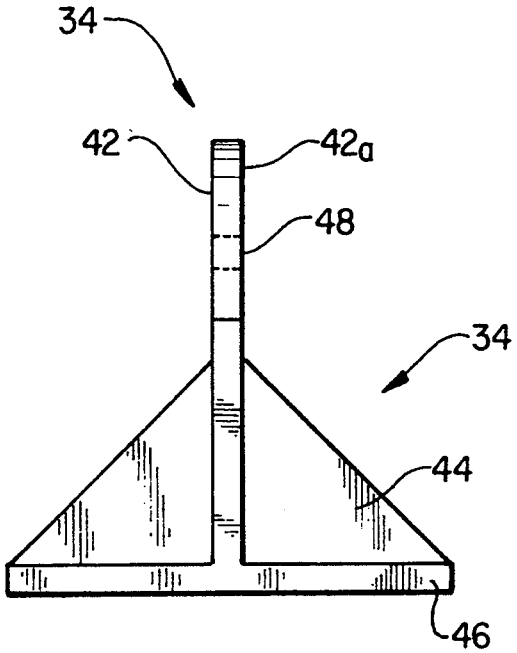
FIG. 2*b* is a top view of the umbrella support flange.
Figure 2C:
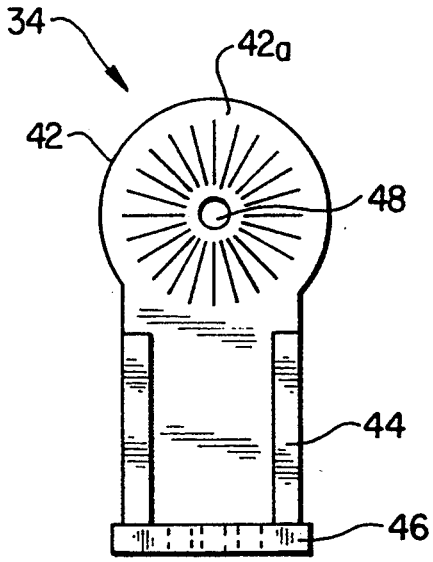
FIG. 2*c* is a side view of the umbrella support flange.
Figure 3A:
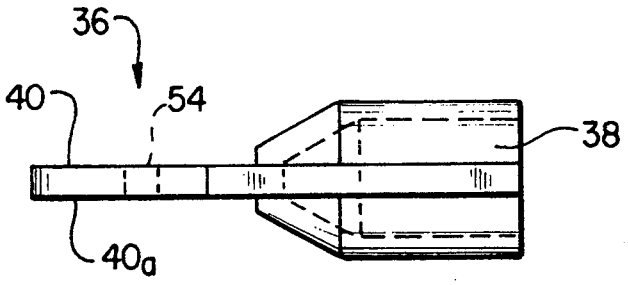
FIG. 3*a* is top view of the support bracket.
Figure 3B:
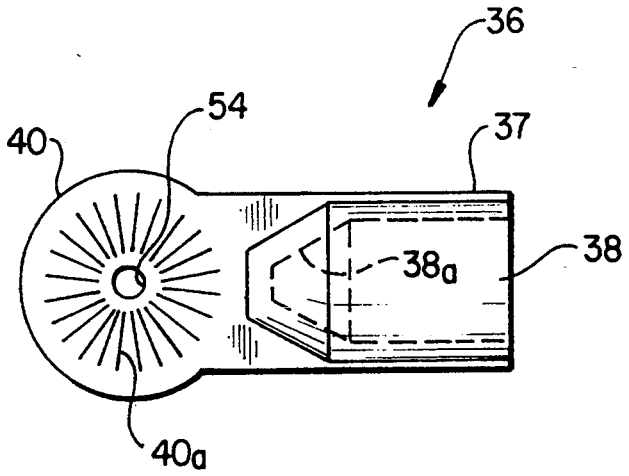
FIG. 3*b* is a side view of the support bracket.
Figure 3C:
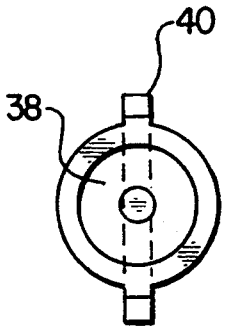
FIG. 3*c* is an end view of the support bracket.

The present invention relates to an improved shading apparatus that overcomes many of the disadvantages found in the prior art. Referring to FIG. 1, a shading apparatus 10 embodying the present invention is disclosed. Shading apparatus 10 comprises umbrella 12, connection means 26, 28, umbrella support bracket 36, and support flange 42.

Umbrella or shader 12 is of sufficient diameter to shade the rider of a riding lawnmower under most conditions. The umbrella 12, in a preferred embodiment, is supported by a single shaft 14. In an alternate embodiment, shown in FIG. 1, the shaft 14 is attached to a U-shaped clamp 16 which in turn is connected to second shaft 18. A wrap 20 and screw 22 can be used to further secure the shaft 14 to the second shaft 18. The distal end 18*a* of second shaft 18 can be fitted into adapter 24. Adapter 24 is next inserted into umbrella support bracket 36, a cylindrical receptacle dimensioned to provide a snug fit for adapter 24. The umbrella support bracket 36 can be pivotally connected to the support flange 34 by connection means. The connection means can be a wing nut 26 penetrating both the bracket 36 and the flange 42. Support flange 34, in turn is connected to the riding lawnmower by a plurality of screws 32. Radial ridges on complementary surfaces 40 and 42 hold the umbrella 12 in position under normal conditions. However, should the umbrella strike a limb, the force imparted to the shaft 14 overcomes the friction forces between surfaces 40 and 42, allowing the umbrella to fall away from the source of the impact.

Referring to FIGS. *2a, 2b,* and *2c,* the support flange 34 is disclosed in greater detail. Flange 34 comprises a base 46 with a plurality of screw holes 50 therethrough. Screws 32 are used to secure the base 46 to the riding mower. The base, in a preferred embodiment is approximately 2 3/16 inches high, 5 inches wide and 5/16 inch in thickness. A flange portion 42 extends perpendicularly from the base 46. This flange portion 42 may extend 5 1/16 inches outward from base 46. A hole 48 is centrally located in flange portion 42. This hole is typically 5/16 inch in radius. A ridged surface 42*a* is located on flange portion 42. Surface 42*a* is comprised of a plurality of radially disposed ridges. Each ridge is typically ¾ inch in length, 3/64 inch in heighth and 1/64 inch wide. Twenty four ridges can be used, each spaced fifteen degrees apart. At least one pair of stabilizers 44 also extend from the base 46 to the flange portion 42.

Referring to FIGS. *3a, 3b,* and *3c,* the umbrella support bracket 36 is disclosed in greater detail. The bracket 36 comprises a bracket body 37 and a bracket head 40. Bracket body 37 surrounds and defines cavity 38. Bracket body 37 is generally cylindrical with a 2 inch diameter in a preferred embodiment. The bracket 36 is typically about 5 ½ inch in length. The cavity 38 extends approximately 2 inches into bracket body 37. Bracket head 40 is generally circular with a centrally located hole 54 which corresponds to hole 48 in support flange 42. The hole 54 has a 11/32 inch diameter in a preferred embodiment, but may be any suitable size. A surface 40*a* is located on bracket head 40. Surface 40*a* is comprised of a plurality of ridges 40*a* similar in size, number and orientation to those on surface 42*a* of flange portion 42. However, the radial ridges on surface 40*a* are offset from those on surface 42*a* by approximately 7 ½ degrees. Thus, the ridges are intermeshed when the bracket 36 is perpendicular to the flange 34.

When the bracket 36 and flange 34 are placed adjacent to and perpendicular to each other, holes 48 and 54 line up. Connection means are placed through these holes to pivotally attach these elements. The connection means can include a threaded wing nut 26 and bolt 28. Washers 30 may also be used as spacers.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

I claim:

1. A shading apparatus for attachment to a riding mower comprising:

(a) a shader comprising an umbrella said umbrella having a vertical centerpost, said centerpost having a releasable clamp means attached to one end, said centerpost is coupled to a supporting shaft by said releasable clamp means such that said centerpost is positioned parallel, and spaced apart from said shaft;

b) pivotal attachment means attaching said shaft to said riding mower, said attachment means comprising:

(i) a shader support bracket removably attached to said shaft, said shader support bracket comprising a bracket body defining a central cavity, said cavity dimensioned to engage said shaft, and a bracket head extending from said bracket body, said bracket head having a centrally located second hole, said bracket head further comprising a second ridged surface;

(ii) a support flange with a base attached to said mower and a flange portion rotatably attached to said shader support bracket, said base having a plurality a screw holes therethrough, said flange portion extending perpendicularly from said base and having a first centrally located hole and a first ridged surface, wherein said pivotal attachment means maintains the shader in a first position by the first and second ridged surfaces which allow said shader to collapse from the first position upon impact with a fixed object.

2. The shading apparatus of claim 1 wherein said first ridged surface complements said second ridged surface such that the frictional force between said first and second ridged surfaces may be overcome by a predetermined force applied to the shader.

3. The shading apparatus of claim 1 wherein said first and second hole align allowing the connection of said bracket and said flange by connection means.

4. The shading apparatus of claim 3 wherein said connection means comprise a wing nut and bolt.

5. A shading apparatus for attachment to a riding mower comprising:

(a) a shader comprising an umbrella said umbrella having a vertical centerpost, said centerpost having a releasable clamp means attached to one end, said centerpost is coupled to a supporting shaft by a releasable clamp means such that said centerpost is positioned parallel, and spaced apart from said shaft;

b) pivotal attachment means attaching said shaft to said riding mower, said attachment means comprising:

(i) a shader support bracket removably attached to said shaft, said shader support bracket comprising a bracket body defining a central cavity, said cavity dimensioned to engage said shaft, and a bracket head extending from said bracket body, said bracket head having a centrally located second hole, said bracket head further comprising a second ridged surface;

(ii) a support flange with a base attached to said mower and a flange portion rotatably attached to said shader support bracket, said base having a plurality a screw holes therethrough, said flange portion extending perpendicularly from said base and having a first centrally located hole and a first ridged surface, said first ridged surface complements said second ridged surface such that the frictional force between said first and second ridged surfaces may be overcome by a predetermined force applied to the shader, said first and second hole aligning to allow the connection of said bracket and said flange; wherein said pivotal attachment means maintains the shader in a first position by the first and second ridged surfaces which allow said shader to collapse from the first position upon impact with a fixed object, and (c) connection means attaching said shader support bracket and said support flange comprising a wing nut and bolt.

* * * * *